United States Patent [19]

Muranaka et al.

[11] 4,180,031

[45] Dec. 25, 1979

[54] METHOD AND SYSTEM FOR CONTROLLING IGNITION SPARK TIMING OF AN INTERNAL COMBUSTION ENGINE OF THE MULTIPLE PLUGS TYPE

[75] Inventors: Shigeo Muranaka, Yokohama; Kōkichi Ochiai, Fujisawa; Makio Waku, Urawa, all of Japan

[73] Assignee: Nissan Motor Company, Limited, Japan

[21] Appl. No.: 686,083

[22] Filed: May 13, 1976

[30] Foreign Application Priority Data

Jul. 2, 1975 [JP] Japan ..... 50-81540

[51] Int. Cl.[2] ..... F02P 7/00; F02P 5/10; F02P 15/02

[52] U.S. Cl. ..... 123/117 A; 123/146.5 A; 123/148 C; 123/148 DS; 200/31 DP; 200/31 V

[58] Field of Search ..... 123/117 R, 146.5 A, 123/148 DS, 148 C, 117 A; 200/31 R, 31 A, 31 V, 31 DP

[56] References Cited

U.S. PATENT DOCUMENTS

| | | | |
|---|---|---|---|
| 1,456,880 | 5/1923 | Rosner | 123/148 C |
| 1,825,720 | 10/1931 | Fitzsimmons | 123/148 C |
| 2,270,982 | 1/1942 | Vanderpoel et al. | 200/31 V |
| 3,874,350 | 4/1975 | Shiraishi | 123/117 R |
| 3,920,041 | 11/1975 | Gropp | 123/117 A |
| 3,929,115 | 12/1975 | Yamauti et al. | 123/148 DS |
| 3,935,844 | 2/1976 | Nishimiya et al. | 123/117 R |
| 3,964,454 | 6/1976 | Nishimiya | 123/117 R |

*Primary Examiner*—Charles J. Myhre
*Assistant Examiner*—Andrew M. Dolinar
*Attorney, Agent, or Firm*—Robert E. Burns; Emmanuel J. Lobato; Bruce L. Adams

[57] ABSTRACT

A method and system for controlling ignition spark timing of an internal combustion engine of the multiple plugs type, in which a plurality of spark plugs are energized at different timings with a predetermined phase in dependence on the flow of air-fuel mixture in a combustion chamber, whereby air-fuel mixture is ignited at timings optimum for rapid combustion.

7 Claims, 15 Drawing Figures

METHOD AND SYSTEM FOR CONTROLLING IGNITION SPARK TIMING OF AN INTERNAL COMBUSTION ENGINE OF THE MULTIPLE PLUGS TYPE

BACKGROUND OF THE INVENTION

This invention relates in general to internal combustion engines of the multi-spark plug type and, more particularly, to a method and apparatus for controlling ignition spark timing for such engines.

As is well known in the art, it has heretofore been proposed to have an internal combustion engine equipped with a plurality of spark plugs adapted to provide a plurality of flames which propagate from a circumference of a wall of a combustion chamber toward a center portion thereof. In this type of engine, the flame propagation distance is less than that of a prior art internal combustion engine of the type having a single spark plug and, therefore, it is possible to effect rapid combustion of air-fuel mixture in the combustion chamber. Accordingly, it makes it possible to increase the exhaust gas recirculation rate up to 40% without sacrificing the performance efficiency of the engine. Another advantage is that the concentration of nitrogen oxides in engine exhaust gases can be remarkably decreased. In a known internal combustion engine of the multi-spark plug type, it has been a usual practice to energize the spark plugs at the same ignition timing. Since, however, the combustion state in the combustion chamber varies in dependence on the state of air-fuel mixture supplied into the combustion chamber and operating conditions of the engine etc. Thus, it is desired that the spark plugs be energized at various ignition timings in dependence on the various factors.

SUMMARY OF THE INVENTION

It is therefore an object of the present invention to provide a method for controlling ignition spark timing of an internal combustion engine of the type having a plurality of spark plugs in a combustion chamber.

It is another object of the present invention to provide a method for controlling ignition spark timing of an internal combustion engine of the multiple plugs type by which exhaust gas recirculation rate can be increased and the concentration of nitrogen oxides in engine exhaust gases can be remarkably decreased.

It is still another object of the present invention to provide a method for controlling ignition spark timing of an internal combustion engine of the multiple plugs type so as to effect optimum flame propagation in a combustion chamber.

It is a further object of the present invention to provide an ignition spark timing control system for an internal combustion engine of the multiple plugs type in which a plurality of spark plugs are energized at predetermined ignition timings to promote flame propagation in a combustion chamber to reduce noxious compounds in engine exhaust gases.

It is a still further object of the present invention to provide an ignition spark timing control system for an internal combustion engine of the multiple plugs type, which system is simple in construction and highly reliable in operation.

It is a still further object of the present invention to provide an ignition spark timing control system for an internal combustion engine, which system is arranged to control ignition spark timing at different phases thereby to effect combustion of air-fuel mixture in a combustion chamber in the most efficient manner.

It is a still further object of the present invention to provide an ignition spark timing control system for an internal combustion engine of the multiple plugs type in which a phase control in ignition spark timing is highly reliably made with a simplified construction and arrangement.

BRIEF DESCRIPTION OF THE DRAWINGS

These and other objects, features and advantages of the present invention will become more apparent from the following description when taken in conjunction with the accompanying drawings, in which.

DESCRIPTION OF THE PREFERRED EMBODIMENTS

Figure 1:
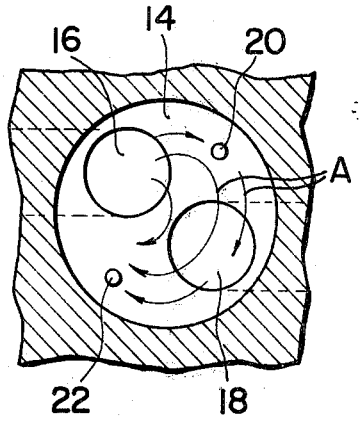
FIG. 1 is a schematic view of a combustion chamber of an internal combustion engine of the multiple plugs type to which the present invention is directed.
Figure 2:
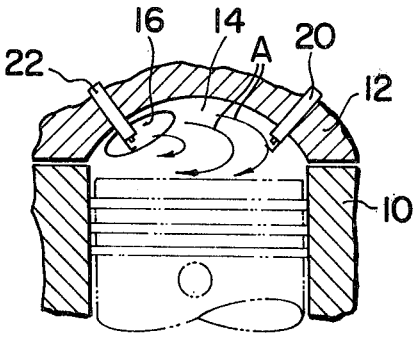
FIG. 2 is a cross sectional view of the internal combustion engine shown in FIG. 1.

Referring now to FIGS. 1 and 2, there is schematically shown an internal combustion engine of the multiple plugs type to which the present invention is directed. The internal combustion engine has a cylinder 10 and a cylinder head 12 mounted thereon. A combustion chamber 14 is formed by the cylinder 10 and the cylinder head 12. The combustion chamber 14 has an intake port 16 and an exhaust port 18, and has two spark plugs 20 and 22 which are directed toward a center portion of the combustion chamber 14. With this construction, air-fuel mixture containing recirculated exhaust gases is supplied through the intake port 16 and flows in a curved direction as shown by arrows A in FIGS. 1 and 2. In this condition, the air-fuel mixture prevailing around the spark plug 20 is at relatively low temperature while the air-fuel mixture prevailing around the spark plug 22 is at relatively high temperature because it is warmed by the cylinder wall. Due to this temperature difference in the air-fuel mixture, the gasified condition of the air-fuel mixture is not homogeneous and, thus, optimum ignition timings for the spark plugs 20 and 22 are not necessarily consistent with one another. Accordingly, if the spark plugs 20 and 22 are ignited at the same ignition timing, a satisfactory combustion effect can not be obtained resulting in the sacrifice in the stability and performance efficiency of the internal combustion engine.

The present invention contemplates the provision of a new method for controlling ignition spark timing of an internal combustion engine of the multi-spark plug type. According to an essential feature of the present invention, a plurality of spark plugs are ignited at different spark timings, i.e., at predetermined phases optimum for respective spark plugs thereby effecting improved combustion of air-fuel mixture in the combustion chamber. This makes it possible to reduce combustion period in the combustion chamber. Thus, the flame propagation speed in the combustion chamber will be maintained at high level even when a larger quantity of recirculated engine exhaust gases is contained in the air-fuel mixture, and, therefore, the concentration of nitrogen oxides in the engine exhaust gases can be remarkably reduced without sacrificing the engine performance efficiency.

In order to achieve this concept, the present invention features to determine the phase difference in ignition spark timing for the plurality of spark plugs by experimental practice in accordance with the state of air-fuel mixture in the combustion chamber. Since the temperature distribution in the air-fuel mixture has an influence on the optimum ignition spark timings for the respective spark plugs, the ignition spark timings may be determined by experimentally measuring the flow of air-fuel mixture in the combustion chamber during intake and compression strokes and the temperature distribution of the air-fuel mixture prevailing around the spark plugs. As already mentioned, since the air-fuel mixture prevailing around the spark plug 20 is lower in temperature than that prevailing around the spark plug 22, it is desirable to ignite the spark plug 20 at a timing prior to the ignition of the second spark plug 22 thereby causing the flame near the first spark plug 20 to propagate at the same speed as that of air-fuel mixture prevailing around the second spark plug 22, whereby total combustion time intervals can be significantly reduced.

It should be noted that since the phase difference in ignition spark timing has a relation with a flow of air-fuel mixture in the combustion chamber during intake stroke and other factors such as squishing action of the air-fuel mixture during a compression stroke and it is difficult to obtain optimum phase difference in accordance with limited factors, it is preferable to determine the optimum phase difference in ignition spark timing through various experiments in view of inherent characteristics of respective internal combustion engines. The experiments have revealed that in an internal combustion engine which is constructed and arranged as shown in FIGS. 1 and 2, the combustion time intervals are remarkably decreased by igniting the spark plugs 20 and 22 at the phase difference ranging from 0 to 15 degrees of crankangle.

Figure 3:
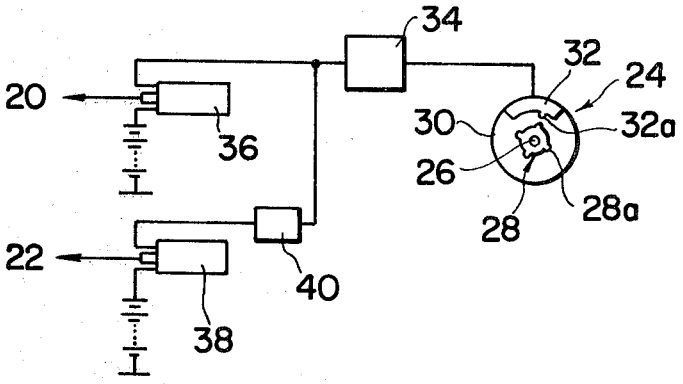
FIG. 3 is an example of an electric circuitry to achieve a method of the present invention.

FIG. 3 illustrates an example of an ignition spark timing control circuit to carry out the method of the present invention. In this illustrated example, the electric circuitry comprises a signal generator of the magnet type. The signal generator, which is generally designated by 24, has a shaft 26 which is connected to a distributor (not shown) and a rotor 28 having cam lobes or projections at its outer periphery corresponding in number of the engine cylinders and fixedly connected to the shaft 26. The signal generator 24 also comprises a casing 30 provided with a pick-up device 32 having a projection 32*a* adapted to generate an ignition signal when one of the projections of the rotor 28 comes to the closest position.

The pick-up device 32 of the signal generator 24 is electrically connected to an amplifying circuit 34 comprising transistors arranged to amplify the ignition signal so that the spark plugs 20 and 22 readily ignite the air-fuel mixture supplied into the combustion chamber.

Ignition coils 36 and 38 are electrically connected to the output of the amplifying circuit 34 in parallel. With this arrangement, the high voltage produced by the amplifying circuit 34 is directly applied to the first spark plug 20, while the high voltage is applied to the second spark plug 22 through a delay circuit 40 so that the second spark plug 22 is energized at a timing delayed from the energization of the first spark plug 20.

With the arrangement mentioned hereinabove, the ignition signal from the signal generator 24 is directly supplied to the ignition coil 36 via the amplifying circuit 34 thereby energizing the first spark plug 20, while the second spark plug 22 is supplied with the ignition signal through the delay circuit 40 so that the second spark plug 22 is energized at a timing posterior to the energization of the first spark plug 20. In this manner, the first and second spark plugs 20 and 22 are consecutively ignited at predetermined phases.

Figure 4:
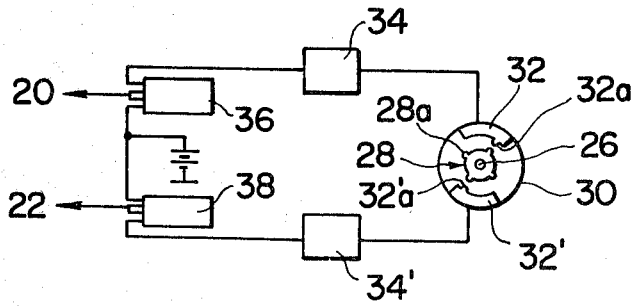
FIG. 4 is another example of an electric circuitry to achieve a method of the present invention.

A modified form of the electric circuitry is shown in FIG. 4, in which like or corresponding component parts are designated by the same reference numerals as those used in FIG. 3. In this illustrated embodiment, the signal generator 24 also has an additional pick-up device 32' having its projection 32'*a* located at an angle corresponding to a predetermined phase with respect to the projection 32*a* of the first pick-up device 32 by which ignition signals are generated at predetermined phases. The ignition signals thus generated are applied through amplifying circuits 34 and 34' to the ignition coils 36 and 38 for thereby energizing the first and second spark plugs 20 and 22 at predetermined phases.

It will now be appreciated that in accordance with the present invention a plurality of spark plugs are ignited at a predetermined phase whereby air-fuel mixture prevailing various parts in a combustion chamber can be ignited at optimum timings resulting in a quick combustion to permit a large proportion of exhaust gas recirculation to reduce nitrogen oxide concentration in engine exhaust gases.

Figure 5:
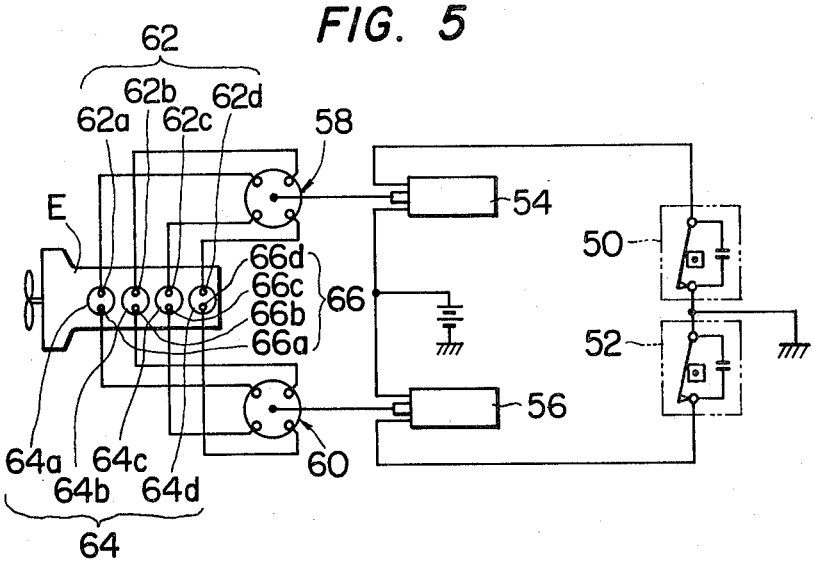
FIG. 5 is a preferred embodiment of an ignition spark timing control system according to the present invention.

Referring now to FIG. 5, there is schematically shown an ignition spark timing control system according to the present invention. As shown, the ignition spark timing control system comprises first and second signal generators 50 and 52 each comprising a breaker arm, a cam adapted to actuate the breaker arm and breaker points. The first and second signal generators 50 and 52 are arranged to generate ignition signals at a predetermined phase, which are applied through first and second ignition coils 54 and 56 to first and second distributors 58 and 60, respectively. The first distributor 58 is connected to first spark plugs 62*a*, 62*b*, 62*c* and 62*d* provided in combustion chambers 64*a*, 64*b*, 64*c* and 64*d*, respectively. Likewise, the second distributor 60 is connected to second spark plugs 66*a*, 66*b*, 66*c* and 66*d* mounted in respective combustion chambers. With the arrangement mentioned above, ignition signals are generated at a timing with a predetermined phase difference by the signal generator 50 and 52. These signals are applied through the ignition coils 54 and 56 and through the distributors 58 and 60 to the first and second spark plugs, which are consequently energized at timings optimum for burning air-fuel mixture in the most efficient manner. The ignition coils and spark plugs may be of any known construction and, therefore, a detailed description of the same is herein omitted.

Figure 6A:
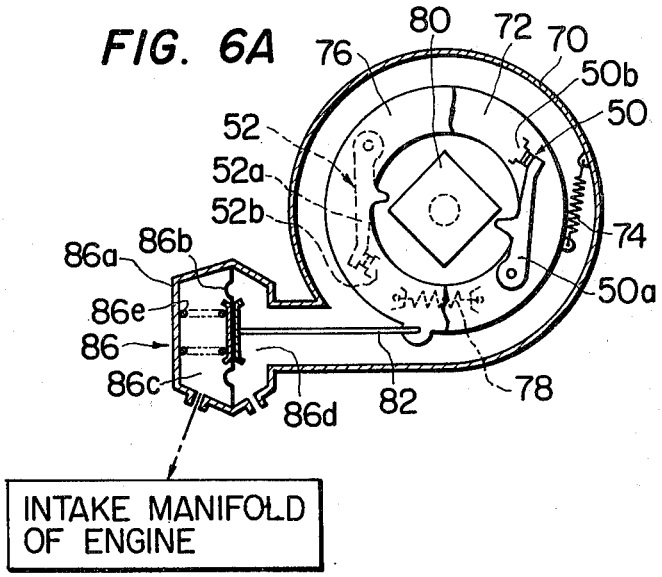
FIGS. 6A and 6B are schematic views illustrating a phase control device forming part of the system shown in FIG. 5.
Figure 6B:
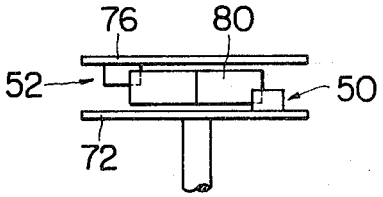

FIGS. 6A and 6B show one example of a phase control device to be used for the ignition spark timing control system shown in FIG. 5. In general, the first and second signal generators 50 and 52 are incorporated in a casing 70 and arranged to cooperate with a vacuum advance control device responsive to suction prevailing in an induction passage upstream of a throttle valve to provide ignition signals at different timings with a predetermined phase in accordance with varying degrees of the suction prevailing in an induction passage upstream of a throttle valve. As shown, the first signal generator 50 comprises a breaker arm 50*a* and a breaker point 50*b*, which are mounted on a first rotatable breaker plate 72. The first breaker plate 72 is urged in a counterclockwise direction as viewed in FIG. 6A by a biasing means such as a tension spring 74. Similarly, the second signal generator 52 comprises a breaker arm 52*a* and a breaker point 52*b*, which are mounted on a second breaker plate 76. The second breaker plate 76 is urged in a counterclockwise direction by a biasing means such as a tension spring 78 connected to the first breaker plate 72. As best shown in FIG. 6B, the second breaker plate 76 is disposed over the first breaker plate 72, between which a breaker cam 80 is rotatably mounted. The second breaker plate 76 thus arranged is connected by a linkage or actuating rod 82 to an actuating device 86. The actuating device 86 comprises a casing 86*a* in which a flexible diaphragm 86*b* divides the casing into vacuum chamber 86*c* and an atmospheric chamber 86*d*. The vacuum chamber 86*c* is connected to a suction prevailing in an induction passage upstream of a throttle valve, while the atmospheric chamber 86*d* is vented to the atmosphere. The flexible diaphragm 86*b* is connected to the actuating rod 82 which in turn is connected to the second breaker plate 76 as previously described. Indicated at 86*e* is a biasing means such as a compression spring which urges the flexible diaphragm 86*b* rightward as viewed in FIG. 6A.

While, in FIGS. 6A and 6B, the supporting means for the first and second breaker plates 72 and 76 are not shown, it should be noted that these breaker plates are rotatably mounted on a stationary plate by bearings in a known manner. The breaker cam 80 is arranged to rotate at a speed proportional to the engine speed in a known manner to actuate breaker arms 50*a* and 52*a* thereby generating ignition signals. It should be understood that the breaker cam 80 has four projections because the engine E shown in FIG. 5 is of the type having four cylinders.

When, in operation, the suction prevailing in an induction passage upstream of a throttle valve is applied to the vacuum chamber 86*c* of the actuating device 86, it acts on the diaphragm 86*b* thereby moving the same leftward as viewed in FIG. 6A until the force developed by the suction prevailing in an induction passage upstream of a throttle valve acting on the diaphragm balances with the force of the compression spring 86*e* and the atmospheric pressure acting on the diaphragm 86*b*. In this instance, the actuating rod 82 is moved leftward with the movement of the diaphragm 86*b*, rotating the second breaker plate 76 clockwise as viewed in FIG. 6A. Rotation of the second breaker plate 76 causes rotation of the first breaker plate 72 via the tension spring 78. It should be noted that it is possible to provide a difference in rotational angle between the first and second breaker plates by arbitrarily selecting the preloads of the tension springs 74 and 78 and the spring constant of each tension spring. Since the rotation of the first breaker plate 72 will cause change in the breaking point or timing of the first signal generator 50 and the rotation of the second breaker plate 76 will cause change in the breaking point or timing of the second signal generator 52, it is possible to cause the first and second signal generators 50 and 52 to generate ignition signals at different timings with a predetermined phase by varying the rotational angles of the respective breaker plates 72 and 76 through the use of the tension springs 74 and 78. It should also be understood that a predetermined phase for an ignition advance may also be provided by positioning the first and second breaker plates at predetermined locations.

As previously noted, the actuating rod 82 of the actuating device 86 is moved to varying degrees in dependence on the instantaneous value of the suction prevailing in an induction passage upstream of the throttle valve, thereby rotating the second breaker plate 76. This causes rotation of the first breaker plate 72 by the tension spring 78 connected between the first and second breaker plates 72 and 76. Under these circumstances, difference will exist in rotational angle between the first and second breaker plates 72 and 76 due to the difference in spring constant between the first and second tension springs 74 and 78. Therefore, ignition signals are generated at different timings with a predetermined phase by the first and second signal generators 50 and 52. Accordingly, the first and second spark plugs in each combustion chamber will be energized at different spark timings thereby effecting rapid combustion of air-fuel mixture in the combustion chamber. It is to be noted that the phase control device mentioned above is arranged to control the ignition spark timing in dependence on the variations in the engine intake manifold vacuum and, thus, a conventional vacuum advance mechanism may be employed in that device.

Figure 7:
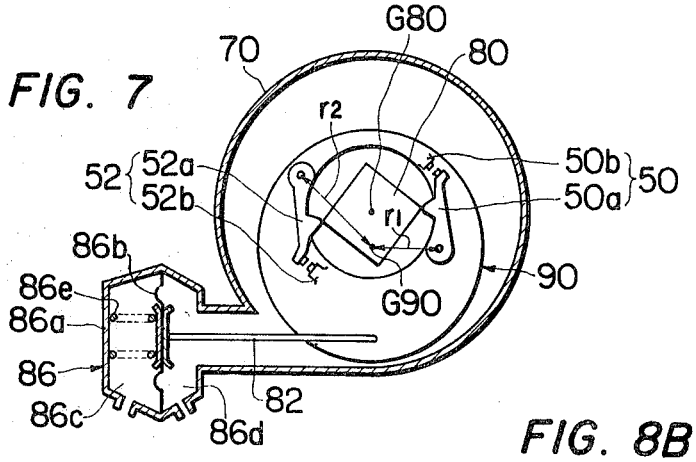
FIG. 7 is a schematic cross sectional view of another phase control device forming part of the system shown in FIG. 5.

FIG. 7 shows a modified form of the phase control device shown in FIGS. 6A and 6B, and corresponding or like component parts are designated by the same reference numerals as those used in FIGS. 6A and 6B. As shown in FIG. 7, the phase control device has a single rotary breaker plate 90 on which first and second signal generators 50 and 52 are operatively mounted. The breaker plate 90 is connected through the actuating rod 82 to the diaphragm 86*b* of the actuating device 86 in a manner as previously described. In this illustrated form, the breaker cam 80 and the rotary breaker plate 90 are arranged such that the center G80 of rotation of the breaker cam 80 and the center G90 of rotation of the breaker plate 90 are eccentric with respect to each other. Further, the first and second signal generators 50 and 52 are located on the breaker plate 90 at symmetric positions with respect to an axis passing through the centers G80 and G90 of the breaker cam 80 and the breaker plate 90. With this arrangement, when the suction prevailing in an induction passage upstream of the throttle valve changes in level, the breaker plate 90 is rotated to a degree in dependence on the variations in the suction prevailing in an induction passage upstream of the throttle valve. As a result, the engaging positions of the breaker arms 50*a* and 52*a* of the first and second signal generators with respect to the breaker cam 80 are changed by a degree corresponding to a difference between rotational radii r1 and r2 of the breaker arms 50*a* and 52*a*, so that ignition signals will be generated at different timings with a predetermined phase. Other operation of the phase control device of FIG. 7 is similar to that of the device shown in FIGS. 6A and 6B and accordingly a detailed description of the same is herein omitted.

Figure 8B:
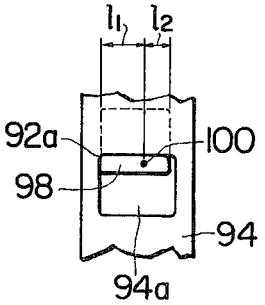
FIGS. 8A, 8B, 8C, 8D and 8E are schematic views showing another example of a phase control device forming part of the system shown in FIG. 5.
Figure 8A:
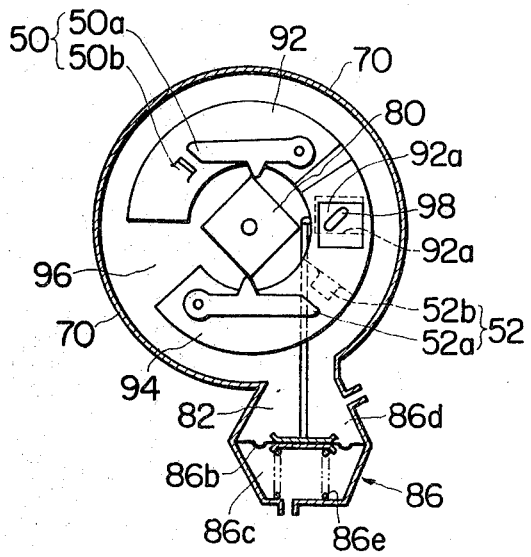
Figure 8C:
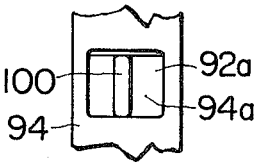
Figure 8E:
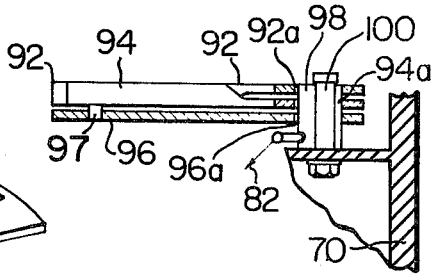
Figure 8D:
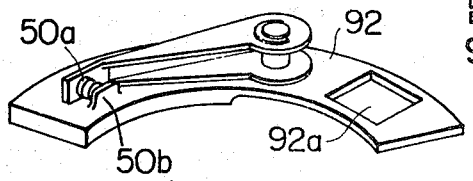

FIGS. 8A, 8B, 8C, 8D and 8E show a still modified form of the phase control device according to the present invention. In this illustrated form, the signal generators 50 and 52 are mounted on first and second breaker plates 92 and 94, respectively, which are partially disposed in layers. The first and second breaker plates 92 and 94 are pivotally mounted on a plate 96 by pins 98 shown in FIG. 8E. As best shown in FIG. 8E, the plates 92, 94 and 96 are formed with bores 92*a*, 94*a* and 96*a*, respectively, through which a cam plate 97 extends. The cam plate 98 is rotatably mounted on a shaft 100 connected to the casing 70. An end of the cam plate 98 is connected to an actuating rod 82 which in turn is connected to a diaphragm 86*b* of an actuating device 86 in a manner as shown in FIG. 8A. As shown in FIGS. 8B and 8C, the cam plate 98 is eccentrically mounted on the shaft 100 and disposed in the bores 92*a* and 94*a* of the first and second breaker plates 92 and 94 such that one end of the cam plate 98 engages with the bore 92*a* of the first breaker plate 92 and the other end of the cam plate 98 engages with the bore 94*a* of the second breaker plate 94. The cam plate 98 thus arranged is actuated by the actuating device 86 through the actuating rod 82 to move the first and second breaker plates 92 and 94 toward and away from each other so that the breaker arms 50*a* and 52*a* engages with the breaker cam 80 at different timings to generate ignition signals. Accordingly, if the first and second signal generators 50 and 52 are disposed on opposed positions at 180 degrees with respect to each other while the cam plate 98 assumes a position as shown in FIG. 8B, the first and second signal generators 50 and 52 will generate ignition signals at the same time. If, on the other hand, the cam plate 98 assumes a position as shown in FIG. 8C, the first and second breaker plates 92 and 94 are displaced from each other at a maximum degree so that a maximum phase difference will exist between the ignition signals generated by the first and second signal generators 50 and 52. The rotational angle of the first and second breaker plates 92 and 94 may be selectively changed by varying ratio of distance $l_1$ and $l_2$ between the end of the cam plate 98 and the central axis of the shaft 100 and another end of the cam plate 98 and the central axis of the shaft 100, respectively. The phase control device thus arranged will operate in a manner similar to that as previously described and, therefore, a detailed description of the same is herein omitted.

Figure 9A:
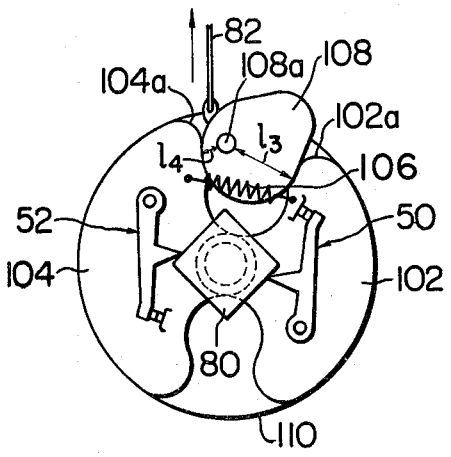
FIGS. 9A and 9B are schematic views showing still another example of a phase control device forming part of the system shown in FIG. 5.
Figure 9B:
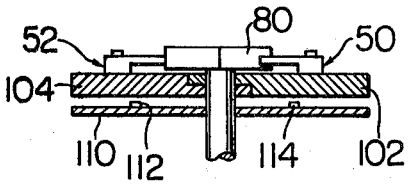

Another modified form of the phase control device is shown in FIGS. 9A and 9B. In this illustrated form, the phase control device comprises first and second contoured breaker plates 102 and 104 having curved faces 102*a* and 104*a*, respectively. These breaker plates 102 and 104 are partially superposed by one another and rotatably supported by a shaft (no numeral) on which the breaker cam 80 is mounted. A biasing means such as a tension spring 106 is connected between the first and second breaker plates 102 and 104 so that the curved faces 102*a* and 104*a* are urged toward each other to engage with an eccentric cam 108 rotatably mounted a shaft 108*a*. The shaft 108*a* is connected to a stationary plate 110 on which bearings 112 and 114 to support the first and second breaker plates 102 and 104 are mounted. The eccentric cam 108 is connected to an actuating rod 82, which in turn is connected to a diaphragm of an actuating device in a manner already described hereinabove.

When the vacuum advance mechanism is actuated, the actuating rod 82 is moved upward as shown by an arrow in FIG. 9A so that the eccentric cam 108 will rotate around the shaft 108*a*. In this instance, the distance $l_3$ between the central axis of the shaft 108*a* and the curved face 102*a* and $l_4$ between the central axis of the shaft 108*a* and the curved face 104*a* will be varied so that the first and second breaker plates 102 and 104 are rotated at different rotational angles. The phase control device thus arranged will operate in a manner as previously mentioned and, therefore, a detailed description of the same is herein omitted.

It will now be appreciated from the foregoing description that in accordance with the present invention a plurality of spark plugs in each combustion chamber of an internal combustion engine are energized at different timings with a predetermined phase whereby air-fuel mixture can be combusted in the most efficient manner.

It will also be understood that in accordance with the present invention a plurality of spark plugs in each combustion chamber of an internal combustion engine are adapted to be energized by independent ignition circuits which are arranged to generate ignition signals at different timings with a predetermined phase and, accordingly, one of the spark plugs in the combustion chamber can be reliably energized even when failure occurs in one of the ignition circuits. It should also be noted that a phase control device for use in an ignition spark timing control system has signal generators which are accommodated in a single casing so as to generate ignition signals whereby the phase control device is simple and compact in construction and low in manufacturing cost.

While the present invention has been shown and described with reference to particular embodiments, it should be noted that various other changes or modifications may be made without departing from the scope of the present invention. For example, more than two spark plugs may be provided in each combustion chamber and, in this case, the ignition spark timing control system may be modified to generate ignition signals at respective timings optimum for each spark plug. Further, while the signal generators have been shown and described as being comprised of breakers, it should be understood that the signal generators may be of the type having transistors.

What is claimed is:

1. In an ignition timing control system for an internal combustion engine of the type wherein first and second spark plugs are disposed in each combustion chamber, the improvement comprising:

a breaker cam rotatably mounted in a casing;

first and second signal generators disposed in the casing and cooperating with and operable by said braker cam, said first and second signal generators being electrically connected to the first and second spark plugs, respectively, and including means for generating the first and second ignition signals at different timings with a predetermined phase difference when the positions of the first and second signal generators relative to said breaker cam are changed to cause the first and second spark plugs to ignite with the predetermined phase difference;

adjustment means for varying said phase difference by changing the positions of said first and second signal generators relative to said breaker cam; and an actuating device operatively connected to the adjustment means to move the adjustment means in response to a suction prevailing in an induction passsage of an engine carburetor of a throttle valve.

2. The improvement according to claim 1, in which said adjustment means comprises first and second breaker plates rotatably mounted in the casing and carrying thereon said first and second signal generators, respectively, said actuating device being connected to said second breaker plate and responsive to said suction prevailing in the induction passage to change the relative position of said first and second breaker plates with respect to said breaker cam, first biasing means connected between said casing and said first breaker plate, and second biasing means connected between said first and second breaker plates, said first and second biasing means having spring constants different from each other, whereby said first and second breaker plates are rotated at different angles by the action of said actuating device.

3. The improvement according to claim 2, in which said actuating device comprises a casing, a flexible diaphragm dividing the interior of said casing into a vacuum chamber and an atmospheric chamber, said vacuum chamber communicating with said suction prevailing in the induction passage, an actuating rod connected between said flexible diaphragm and said one of said first and second breaker plates, and a biasing means disposed in said vacuum chamber and urging said flexible diaphragm in one direction.

4. The improvement according to claim 1, in which said adjustment means comprises a breaker plate rotatably disposed in said casing at a position eccentric with respect to the rotatable axis of said breaker cam and carrying thereon said first and second signal generators, and said actuating device being connected to said breaker plate and responsive to said suction prevailing in the induction passage to rotate said breaker plate to a position in which said first and second signal generators generate ignition signals at different timings with a predetermined phase in dependence on the intake manifold vacuum of the engine acting on said actuating device.

5. The improvement according to claim 1, in which said adjustment means comprises first and second breaker plates partially overlapped with each other and having bores, respectively, said first and second breaker plates carrying thereon said first and, second signal generators cooperating with said breaker cam, a cam plate disposed in said bores of said first and second breaker plates such that one end of said cam plate engages with a wall of the bore of said first breaker plate and another end of said cam plate engages with a wall of the bore of said second breaker plate, and said actuating device being connected to said cam plate and responsive to said suction prevailing in the induction passage to rotate said cam plate, whereby relative position of said first and second breaker plates is changed in dependence on the instantaneous value of said suction prevailing in the induction passage to cause said first and second signal generators to generate ignition signals at different timings with a predetermined phase in dependence on the instantaneous value of said suction prevailing in the induction passage.

6. The improvement according to claim 5, in which said first and second breaker plates are pivoted at their end portion to a stationary plate provided in said casing.

7. The improvement according to claim 1 in which said adjustment means comprises first and second rotary breaker plates and carrying thereon said first and second signal generators, a shaft rotatably mounting said breaker cam, said first and second breaker plates being rotatably supported by said shaft on which said breaker cam is rotatably mounted, a stationary plate, an eccentric cam rotatably mounted on said stationary plate and engaging with end portions of said first and second breaker plates, and said actuating device being connected to said eccentric cam and responsive to said suction prevailing in the induction passage to rotate said eccentric cam to a degree in dependence on the instantaneous value of said suction prevailing in the induction passage acting on said actuating device, whereby said first and second signal generators generate ignition signals at different timing with a predetermined phase in dependence on the instantaneous value of said suction prevailing in the induction passage.

* * * * *